US006002909A

United States Patent [19]

Furuyama et al.

[11] Patent Number: 6,002,909

[45] Date of Patent: Dec. 14, 1999

[54] IMAGE FORMING APPARATUS FOR PREVENTING GENERATION OF IMAGE DEFECTS FROM DEFORMATION OF A PRESSURE ROLLER

[75] Inventors: Tetsuya Furuyama; Kenji Hara, both of Ebina, Japan

[73] Assignee: Fuji Xerox Co., Ltd., Tokyo, Japan

[21] Appl. No.: 09/115,639

[22] Filed: Jul. 15, 1998

[30] Foreign Application Priority Data

Jul. 25, 1997 [JP] Japan ..... 9-200506

[51] Int. Cl.[6] ..... G03G 15/20

[52] U.S. Cl. ..... 399/328; 399/330; 399/331; 399/333

[58] Field of Search ..... 399/328, 330, 399/331, 333; 219/469, 470

[56] References Cited

U.S. PATENT DOCUMENTS 4,814,819 3/1989 Torino et al. ..... 355/3

4,935,785 6/1990 Wildi et al. ..... 355/290

FOREIGN PATENT DOCUMENTS

B2-62-4716 1/1987 Japan .

A-62-47669 3/1987 Japan .

A-7-334027 12/1995 Japan .

*Primary Examiner*—Richard Moses

*Assistant Examiner*—Shival Virmani

*Attorney, Agent, or Firm*—Oliff & Berridge, PLC

[57] ABSTRACT

An image forming apparatus having a fixing unit for performing a fixing process by bringing a fixing member having a heat source and a pressurizing member having an elastic layer into contact with each other, wherein control is performed such that a portion in the vicinity of a deformed portion of the pressurizing member and the leading end of the transfer member do not coincide with each other.

15 Claims, 14 Drawing Sheets

SMEAR PORTION

NORMAL PORTION

IMAGE FORMING APPARATUS FOR PREVENTING GENERATION OF IMAGE DEFECTS FROM DEFORMATION OF A PRESSURE ROLLER

BACKGROUND OF THE INVENTION

The present invention relates to an image forming apparatus, such as a copying machine, a printer or a facsimile apparatus employing an electrophotographic method, and more particularly to an image forming apparatus which is capable of preventing an image trouble, such as disorder of a formed image defect called a "smear" occurring during a transferring operation caused from deformation of a pressuring roll of a fixing unit.

Hitherto, a portion of image forming apparatuses, such as copying machines, printers and facsimile apparatuses has a structure that a toner image formed on a photosensitive drum formed is transferred to the surface of a transfer member, such as transfer paper, by a transferring roller arranged to be brought into contact with the surface of the photosensitive drum and supplied with a bias voltage. Moreover, the toner image transferred to the transfer member is fixed with heat and pressure in a fixing unit so that an image is formed. The fixing unit provided for the foregoing image forming apparatus has a structure that a metal fixing roller including a heat source and a pressuring roller having a surface coated with an elastic layer are brought into contact with each other. Moreover, a transfer member to which a toner image has been transferred is allowed to pass through a contact portion between the fixing roller and the pressurizing roller so that the toner image is fixed to the surface of the transfer member with heat and pressure.

Since the fixing unit of the above-mentioned image forming apparatus has the structure that the fixing roller and the pressurizing roller are always in contact with each other, the portion of the elastic layer of the pressurizing roller which is in contact with the fixing roller is undesirably deformed when the operation of the image forming apparatus is interrupted. If the elastic layer of the pressurizing roller of the fixing unit is deformed, a problem arises when a transfer member to which a toner image has been transferred is fixed when a next image forming process is performed. That is, when a portion in the vicinity of the leading end of the transfer member has been introduced into the deformed portion of the pressurizing roller, change in the outer diameter of the pressurizing roller occurring because of the deformation of the pressurizing roller causes the moving speed of the transfer member to be changed (oscillated), the transfer member being moved in a state in which the transfer member is held in the contact portion between the fixing roller and the pressurizing roller. As a result, moving speed of the trailing end of the transfer member which is positioned in a transferring position of the photosensitive drum is changed. Thus, there arises a problem in that the toner image which is transferred from the photosensitive drum to the surface of the transfer member encounters disorder of an image called a "smear" occurs, as shown in FIGS. 15 and 16.

To prevent disorder of an image called a "smear" caused from the deformation of the pressurizing roller, an amount of a loop of the transfer member has been enlarged between the transferring portion of the photosensitive drum and the fixing unit. Thus, change in the moving speed of the transfer member occurring because of the deformation of the pressurizing roller exerts an influence on the transferring portion of the photosensitive drum.

However, the above-mentioned conventional technology has the following problems. That is, the foregoing conventional image forming apparatus incorporates the fixing unit having the metal fixing roller, which includes the heat source, and a pressurizing roller having the surface coated with the elastic layer. To improve the fixing performance of, in particular, small-size apparatuses, a portion of the apparatuses incorporates a thick elastic member which forms the elastic layer of the pressurizing roller. In this case, there arises a problem in that the amount of the deformation of the pressurizing roller is too large, the deformation cannot satisfactorily be restored and thus disorder of an image called a "smear" occurring because of the deformation of the pressurizing roller cannot effectively be prevented.

In recent years, size reduction of the image forming apparatus has been required by reducing the distance from the transferring portion of the Photosensitive drum to the fixing unit, that is, a short paper path has been employed. Thus, space reduction is attempted. Therefore, the amount of the loop of the transfer member cannot be enlarged between the transferring portion of the photosensitive drum and the fixing unit. What is worse, oscillations of the transfer member occurring because of the deformation of the pressurizing roller can easily be propagated to the transferring portion. Therefore, there arises a problem in that disorder of an image called a "smear" easily occurs because of the deformation of the pressurizing roller.

When a transferring roller arranged to be brought into contact with the surface of the photosensitive drum and applied with a bias voltage is employed in place of a corona type unit in order to prevent generation of ozone or the like from the transferring means, slip transference is usually employed to prevent an image defect called a "hollow character". Therefore, there arises a problem in that the force for moving the transfer member at the transferring position of the photosensitive drum is unsatisfactorily weak, an influence of oscillations of the transfer member occurring because of deformation of the pressurizing roller is easily exerted and disorder of an image called a "smear" easily occurs because of deformation of the pressurizing roller.

The image defect called a "hollow character" arises when a transferring roller 101 serving as the transferring means arranged to be brought into contact with the surface of a photosensitive drum 100 and applied with a bias voltage is used. When a toner image 102 having a somewhat large width is transferred to a transfer member 103 in the axial direction of the photosensitive drum 100 as shown in FIG. 13, the transferring roller 101 which is brought into contact with the surface of the photosensitive drum 101 is deformed, as shown in FIG. 14. Therefore, the pressing force at the central portion of the toner image is weakened, causing a phenomenon to occur in which the central portion of the toner image 102 is not transferred and white portion is undesirably generated.

To prevent occurrence of an image defect called a "hollow character", the image forming apparatus incorporating the transferring roller usually employs slip transfer with which transference is performed while the transfer member is slipped between the photosensitive drum and the photosensitive drum. Since the transfer paper is in a slippage state with respect to both of the photosensitive drum and the transferring roller, the transfer paper cannot stably be moved. Thus, there arises a problem in that image disorder called a "smear" easily occurs because of the deformation of the pressurizing roller.

Recently, image forming apparatuses have been digitized to improve the image quality and enable a variety of image processes to be performed. Thus, a portion of the apparatuses forms an image by exposing dot images to light and by developing the same. Therefore, there arises a problem in that the image disorder called a "smear" occurring because of deformation of the pressurizing roller becomes critical.

Image forming apparatuses developed recently have high processing speeds to satisfy a required for raising the speed. Since the processing speed has been raised, oscillations of the transfer member are intensified because of deformation of the pressurizing roller. Thus, there arises a problem in that image disorder called a "smear" easily occurs because of deformation of the pressurizing roller.

As a means for solving the above-mentioned problems, a method arranged as disclosed in, for example, the Unexamined Japanese Patent Application No. Sho 62-47669 may be employed, the method being arranged such that a large loop is provided for the transfer member at a position between the transferring position of the photosensitive drum and the fixing unit so as to prevent easy propagation of the oscillation of the transfer member caused from the deformation of the pressurizing roller.

However, the above-mentioned method encounters another problem in that an attempt to provide a large loop for the transfer member at the position between the transferring position of the photosensitive drum and the fixing unit causes the transfer member, to which a non-fixed toner image has been transferred, to easily be brought into contact with an adjacent member because the sizes of the image forming apparatuses have been reduced. Thus, rubbing of an image defect called a "smudge" occurs critically to actually employ the above-mentioned method.

A method arranged as disclosed in the Examined Japanese Patent Application Publication No. Sho 62-4716 may be employed, the method having a structure that the pressure applied to the fixing roller and the pressurizing roller is suspended when a copying cycle has been completed so that deformation of the pressurizing roller is prevented. In this case, a mechanism for suspending the pressure applied to the fixing roller and the pressurizing roller must be added. Thus, the cost and the size of the apparatus are enlarged. What is worse, a process for suspending the pressure applied to the fixing roller and the pressurizing roller must be performed when the copying cycle has been completed. As a result, there arises problems in that the productivity deteriorates and reliability becomes unsatisfactory because the process for pressuring the fixing roller and the pressurizing roller and the pressure suspending process must be performed.

A method arranged as disclosed in the Unexamined Japanese Patent Application publication No. Hei 7-334027 may be employed, the method being formed such that idle rotation of the pressurizing roller is performed before the image forming process is started. In the above-mentioned case, start of the image forming operation cannot quickly be performed. To restore the deformation of the pressurizing roller, the pressurizing roller must be rotated for several minutes. That is, there arises a problem in that a long waiting time is required.

SUMMARY OF THE INVENTION

Accordingly, an object of the present invention is to solve the above-mentioned technical problems experienced with the conventional technologies. That is, an object of the present invention is to provide an image forming apparatus which is capable of preventing generation of an image defect called a "smudge", reducing the cost and size of the apparatus, maintaining productivity and reliability, eliminating a necessity of waiting for start of an image forming operation and effectively preventing image disorder called a "smear" occurring because of deformation of a pressurizing roller.

That is, according to an aspect of the present invention of aspect 1, there is provided an image forming apparatus comprising a fixing unit for performing a fixing process by bringing a fixing member having a heat source and a pressurizing member having an elastic layer into contact with each other, wherein control is performed such that a portion in the vicinity of a deformed portion of the pressurizing member and the leading end of a transfer member do not coincide with each other.

Although the fixing member is, for example, a metal fixing roller including the heat source, the present invention is not limited to the foregoing structure. A member formed by coating the surface of a metal cylindrical member with an elastic layer may be employed. The above-mentioned pressurizing member which is formed into, for example, a structure obtained by coating a metal core with the elastic layer may be a member having a surface provided with a coating layer.

According to another aspect of the present invention of aspect 2, there is provided an image forming apparatus having a structure of aspect 1, wherein the deformed portion of the pressurizing member is a contact portion with the fixing member immediately before an image forming operation is started.

According to another aspect of the present invention of aspect 3, there is provided an image forming apparatus having a structure of aspect 1, wherein the deformed portion of the pressurizing member is a contact portion with the fixing member immediately before an image forming operation is started and a contact portion with the fixing member immediately before a previous image forming operation is started.

According to another aspect of the present invention of aspect 4, there is provided an image forming apparatus having a structure of aspect 1, wherein the deformed portion of the pressurizing member is a contact portion with the fixing member when the image forming apparatus has been allowed to stand for a long time in a state in which an image forming operation is interrupted.

According to another aspect of the present invention of aspect 5, there is provided an image forming apparatus having a structure of aspect 4, wherein a state in which a power source for the image forming apparatus is turned on and a state in which the mode is returned from a special mode or a power saving mode are determined as a state where the image forming apparatus is allowed to stand for a long time is determined.

According to another aspect of the present invention of aspect 6, there is provided an image forming apparatus having a structure of aspect 1, wherein control is performed such that the leading end of the transfer member is introduced into a contact portion between the fixing member and the pressurizing member immediately after the deformed portion of the pressurizing member has passed through the contact portion with the fixing member.

According to another aspect of the present invention of aspect 7, there is provided an image forming apparatus having a structure of any one of aspects 1 to 6, wherein only a first sheet in a sequential image forming job is controlled such that the portion in the vicinity of the deformed portion of the pressurizing member and the leading end of the transfer member do not coincide with each other.

According to another aspect of the present invention of aspect 8, there is provided an image forming apparatus comprising a fixing unit for performing a fixing process by bringing a fixing member having a heat source and a pressurizing member having an elastic layer into contact with each other, wherein control is performed such that a deformed portion of the pressurizing member is stopped such that the deformed portion of the pressurizing member is made to be apart from a portion in the vicinity of the contact and stop position with the fixing member.

According to another aspect of the present invention of aspect 9, there is provided an image forming apparatus having a structure of aspect 8, wherein the deformed portion of the pressurizing member is a contact portion with the fixing member immediately before an image forming operation is started.

According to another aspect of the present invention of aspect 10, there is provided an image forming apparatus having a structure of aspect 8, wherein the deformed portion of the pressurizing member is a contact portion with the fixing member immediately before an image forming operation is started and a contact portion with the fixing member immediately before a previous image forming operation is started.

According to another aspect of the present invention of aspect 11, there is provided an image forming apparatus having a structure of aspect 8, wherein the deformed portion of the pressurizing member is a contact portion with the fixing member when the image forming apparatus has been allowed to stand for a long time in a state in which an image forming operation is interrupted.

According to another aspect of the present invention of aspect 12, there is provided an image forming apparatus having a structure of aspect 8, wherein a state in which a power source for the image forming apparatus is turned on and a state in which the mode is returned from a special mode or a power saving mode are determined as a state where the image forming apparatus is allowed to stand for a long time is determined.

According to another aspect of the present invention of aspect 13, there is provided an image forming apparatus having a structure of aspect 8, wherein control is performed such that the pressurizing member is stopped immediately after a portion in the vicinity of the deformed portion of the pressurizing member has passed through a contact portion with the fixing member.

According to another aspect of the present invention of aspect 14, there is provided an image forming apparatus having a structure of any one of aspects 1 to 13, wherein control means for controlling the operation performs control in accordance with a count of encoder pulses of a main motor.

DETAILED DESCRIPTION OF THE PREFERRED EMBODIMENTS

Embodiments of the present invention will now be described with reference to the drawings.

(First Embodiment)

Figure 4:
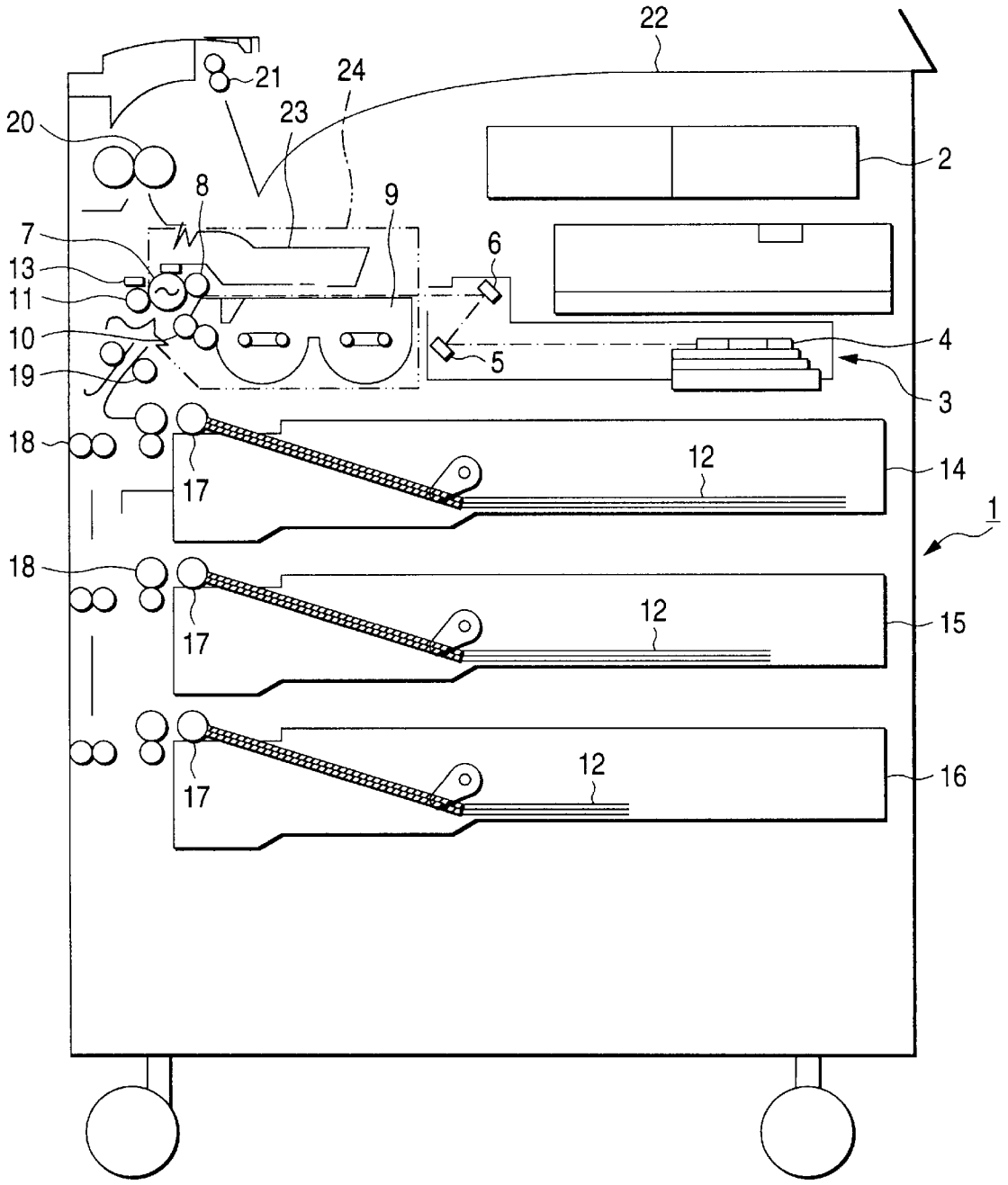
FIG. 4 is a diagram showing the image forming apparatus according to the embodiment of the present invention.

FIG. 4 shows an embodiment of an image forming apparatus having a fixing unit according to the present invention, the image forming apparatus also having a function to serve as a copying machine, a facsimile machine and a printer.

Referring to FIG. 4, reference numeral 1 represents a body of the image forming apparatus. An image processing apparatus 2 for subjecting image information read by an image reading unit (not shown) for reading the image of an original document and image information supplied from a personal computer or the like to predetermined image processes is disposed in the upper portion in the body 1 of the image forming apparatus. Moreover, a ROS (Raster Output Scanner) 3 is disposed in the above-mentioned portion. The ROS 3 exposes an image to laser beam LB in accordance with image information.

As shown in FIG. 4, a semiconductor laser unit in the ROS 3 emits a laser beam LB in accordance with gradation data of image information. The laser beam LB emitted from the semiconductor laser unit is polarized and scanned by a rotational polygonal mirror 4, and then used to scan and expose the surface of the photosensitive drum 7 to the laser beam LB through reflecting mirrors 5 and 6.

The photosensitive drum 7 which is scanned and exposed to the laser beam LB by the ROS 3 is made of a photosensitive material composed of an organic photoconductive material. The photosensitive drum 7 is rotated at predetermined speed in a direction indicated by an arrow by a drive means (not shown). The surface of the photosensitive drum 7 is, as shown in FIG. 4, previously electrically charged to a predetermined potential by a charge roll 8. Then, the surface of the photosensitive drum 7 is scanned and exposed to the laser beam LB so that an electrostatic latent image is formed on the foregoing surface. The electrostatic latent image is developed by a developing roll 10 of a developing unit 9 so that a toner image is formed.

The toner image formed on the photosensitive drum 7 is transferred to the surface of transfer paper 12 by a transferring roll 11 disposed so as to be brought into contact with the photosensitive drum 7. Then, the transfer paper 12 to which the toner image has been transferred is destaticized by a separation charger 13 comprising a needle electrode so that the transfer paper 12 is separated from the photosensitive drum 7. The separation charger 13 comprising the needle electrode is applied with a DC voltage. The transfer paper 12 is, as shown in FIG. 4, fed by a feed roll 17 from any one of a plurality of paper cassettes 14, 15 and 16 disposed in a lower portion in the body 1 of the image forming apparatus. The fed transfer paper 12 is, by a conveying roller 18 and a resist roller 19, moved to the surface of the photosensitive drum 7.

The transfer paper 12 to which the toner image has been transferred from the surface of the photosensitive drum 7 is, as described above, destaticized by the separation charger 13 comprising the needle electrode so that the transfer paper 12 is separated from the surface of the photosensitive drum 7. Then, the transfer paper 12 is moved to a fixing unit 20 according to the embodiment of the present invention so that the toner image is fixed to the surface of the transfer paper 12 with heat and pressure in the fixing unit 20. Then, the transfer paper 12 is discharged to the upper surface of the paper-discharge tray 22 by a discharge roll 21. Thus, the process for forming an image is completed.

The surface of the photosensitive drum 7 in a state in which the process for transferring the toner image has been completed is, by a cleaning unit 23 having a cleaner blade or a brush, cleaned such that residual toner and paper dust are removed. Thus, preparation for a next image forming process is performed.

The image forming apparatus structured as described above is attempted to easily perform maintenance and so forth by employing a structure that the photosensitive drum 7, the developing unit 9, the cleaning unit 23 and so forth disposed adjacent to the photosensitive drum 7 are integrally formed into a CRU 24. The CRU 24 is made to be integrally detachable with respect to the body 1 of the image forming apparatus.

Figure 2:
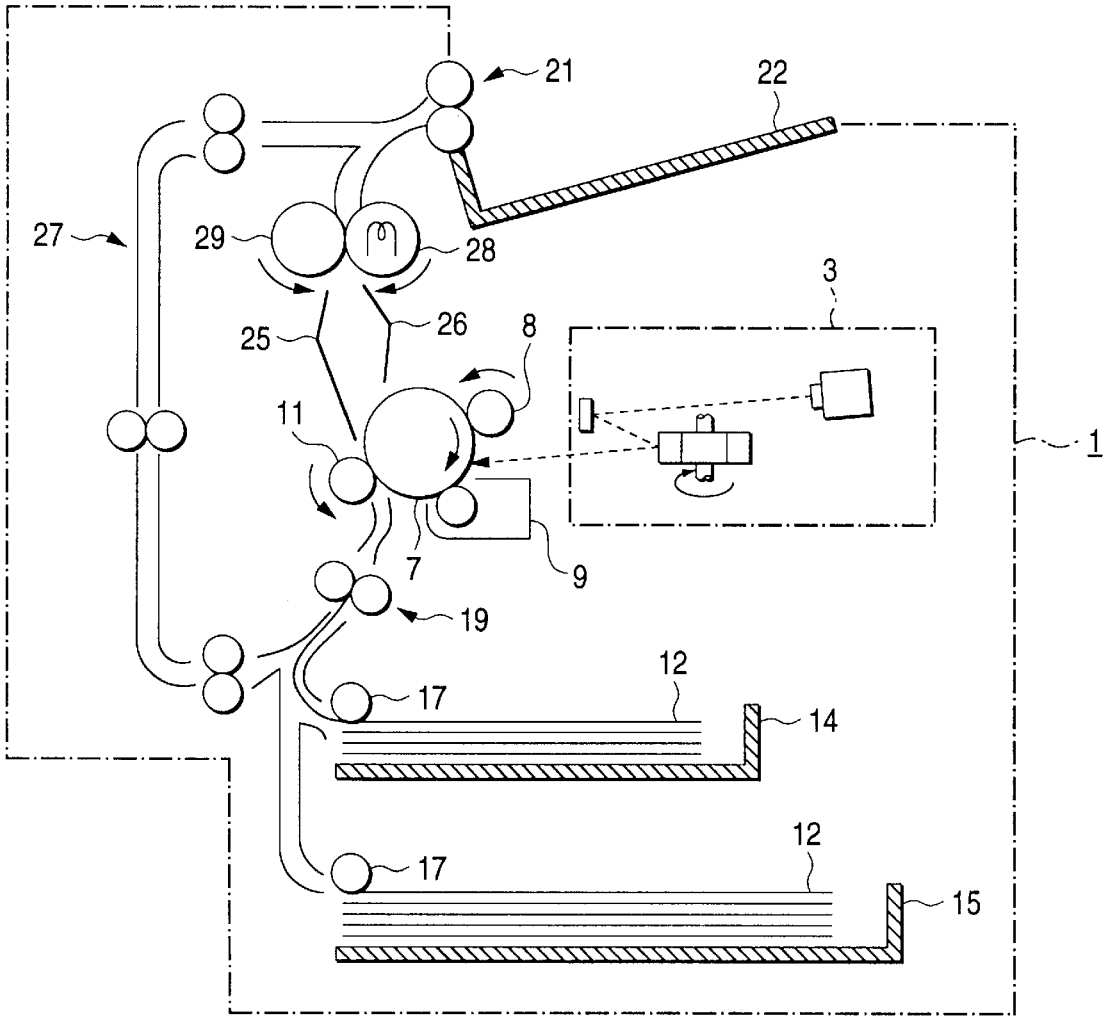
FIG. 2 is a diagram showing the structure of the image forming apparatus according to the embodiment of the present invention.

FIG. 2 is a diagram showing the structure of a conveying system for transfer paper in the image forming apparatus having the above-mentioned structure.

In the image forming apparatus, as shown in FIG. 2, the transfer paper 12 fed from any one of the plural paper cassettes 14 and 15 by the feed roll 17 is, through the resist roller 19, moved to a transferring position at which the photosensitive drum 7 and the transferring roll 11 are brought into contact with each other. Then, a toner image is transferred from the surface of the photosensitive drum 7 to the transfer paper 12, and then the transfer paper 12 is guided by paper guides 25 and 26 so that the transfer paper 12 is moved to the fixing unit 20. The toner image transferred to the surface of the transfer paper 12 is fixed to the surface of the transfer paper 12 with heat and pressure in the fixing unit 20. Then, the transfer paper 12 is usually discharged to the upper surface of the paper-discharge tray 22 by the discharge roll 21.

When images are formed on the two sides of the transfer paper 12, the transfer paper 12 fixed by the fixing unit 20 is not discharged to the upper surface of the paper-discharge tray 22 by the discharge roll 21. In the foregoing case, the rotation of the discharge roll 21 is temporarily interrupted in a state in which the trailing end of the transfer paper 12 is held by the discharge roll 21. Then, the discharge roll 21 is rotated inversely so that the transfer paper 12 to which a toner image has been fixed to either side thereof is again moved to the transferring position through a paper inverting passage 27. Thus, a toner image is transferred and fixed to the reverse side of the transfer paper 12, and then the transfer paper 12 is discharged to the upper surface of the paper-discharge tray 22 by the discharge roll 21.

Figure 3:
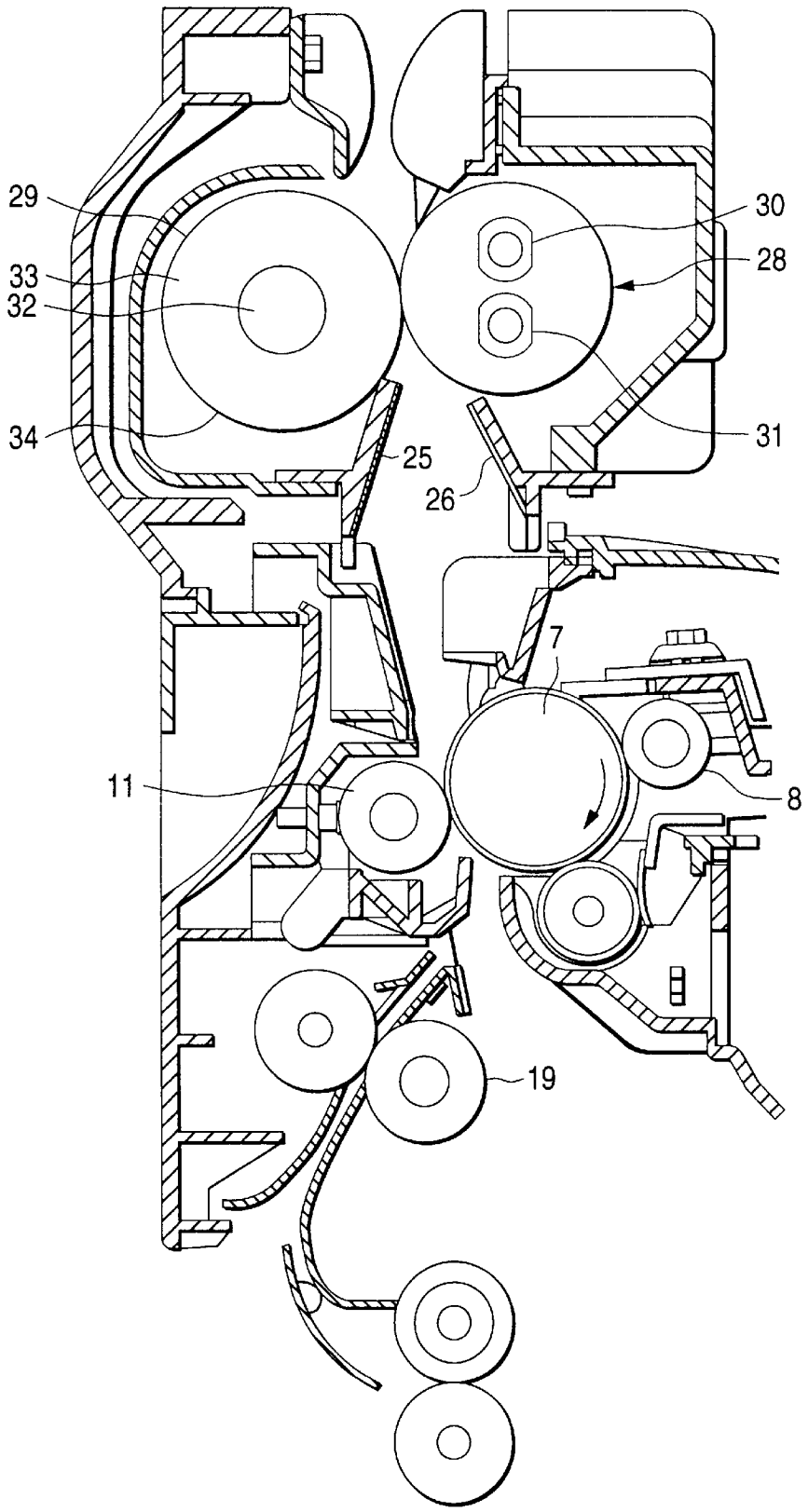
FIG. 3 is a diagram showing the image forming apparatus according to the embodiment of the present invention.

FIG. 3 shows a further specific structure of the image forming apparatus having the above-mentioned structure.

Referring to the drawing, the fixing unit 20 has a structure that a metal fixing roller 28 including a heat source and a pressurizing roller 29 having a surface coated with an elastic layer are brought into contact with each other. Moreover, the transfer paper 12 on which a toner image has been transferred and which serves as the transfer member is allowed to pass through a contact portion between the fixing roller 28 and the pressurizing roller 29. Thus, the toner image is fixed to the surface of the transfer paper 12 with heat and pressure.

The fixing roller 28 is formed into a cylindrical shape having a thin wall and made of a metal material, such as aluminum or stainless steel. The fixing roller 28 includes two halogen lamps 30 and 31 serving as heat sources and set to different watts. If necessary, a coating layer made of teflon or the like is provided on the surface of the fixing roller 28. The pressurizing roller 29 has a structure that the outer surface of a metal core 32 made of aluminum or stainless steel is coated with a thick elastic layer 33 made of foam sponge rubber, such as silicon or urethane. If necessary, the surface of the elastic layer 33 is coated with a PFA tube 34.

The fixing unit 20 has a structure that the fixing roller 28 and the pressurizing roller 29 each having the above-mentioned structure are brought into contact with each other under a predetermined pressure. The fixing roller 28 and the pressurizing roller 29 are rotated in a state in which the surface of the fixing roller 28 is heated to a predetermined level by the halogen lamps 30 and 31. Thus, the transfer paper 12 to which the toner image has been transferred is allowed to pass through the contact portion between the fixing roller 28 and the pressurizing roller 29 so that the toner image is fixed to the surface of the transfer paper 12 with heat and pressure.

Figure 1A:
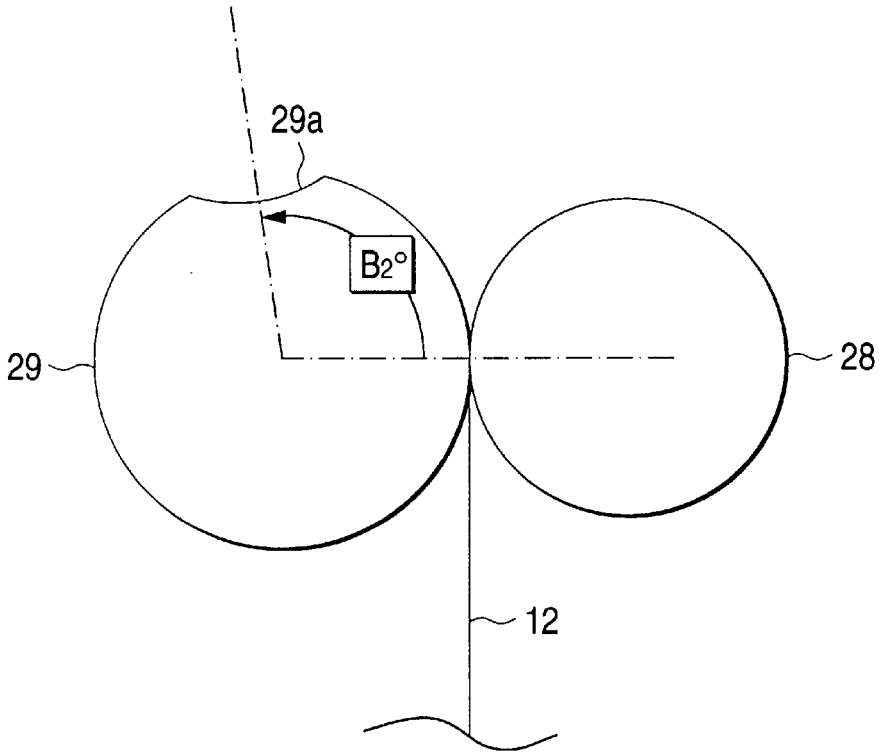
FIGS. 1A and 1B are diagrams showing an essential portion of an image forming apparatus according to an embodiment of the present invention.
Figure 1B:
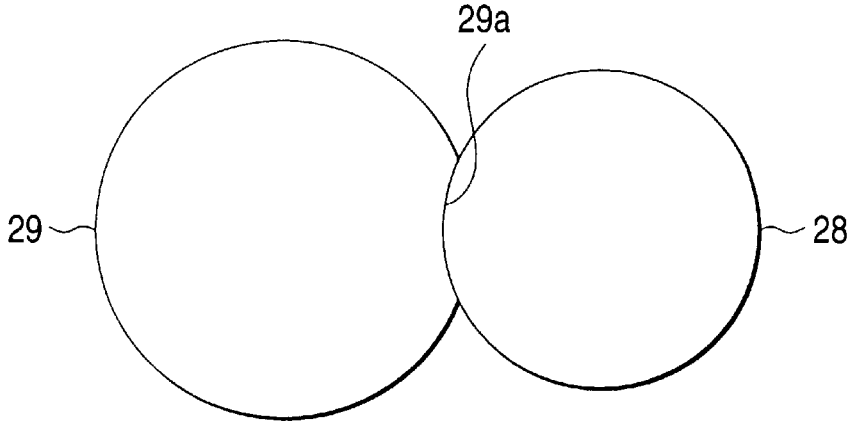

Since the fixing unit 20 has the structure that the fixing roller 28 and the pressurizing roller 29 are in contact with each other under a predetermined pressure, the rotations of the fixing roller 28 and the pressurizing roller 29 are interrupted in a state in which the metal fixing roller 28 is in contact with the elastic layer 33 of the pressurizing roller 29, as shown in FIG. 1B. Therefore, the elastic layer 33 of the pressurizing roller 29 is deformed as shown in FIG. 1B because the fixing roller 28 is pressed.

Therefore, the image forming apparatus according to this embodiment has a structure that control is performed in such a manner that a portion in the vicinity of the deformed portion of the pressurizing member and the leading end of the transfer member do not coincide with each other, as shown in FIG. 1A.

Figure 5:
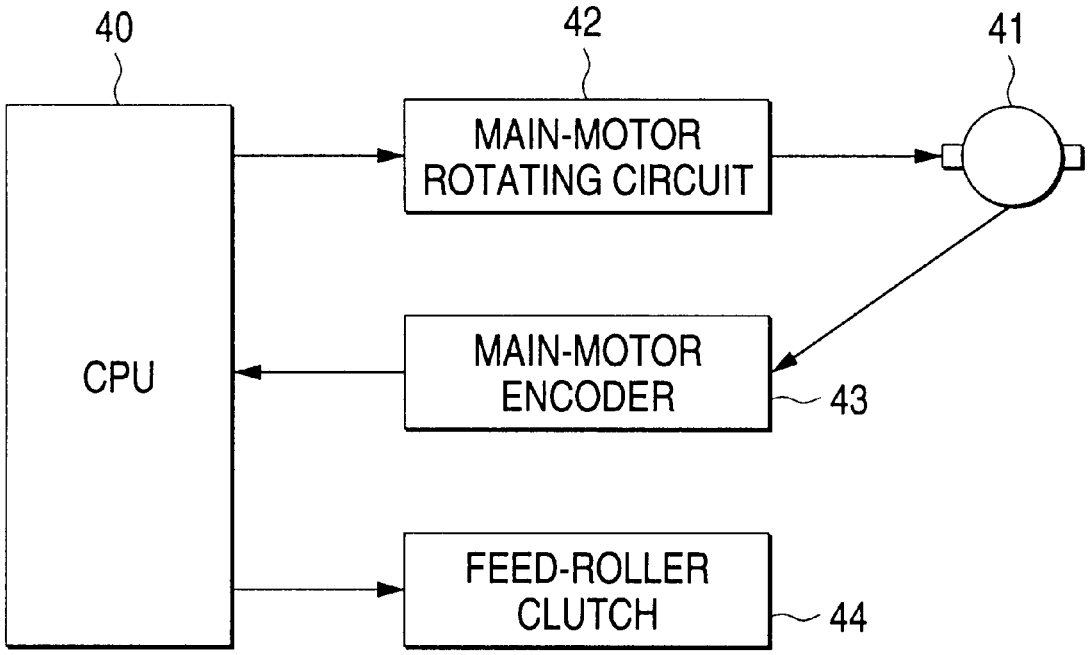
FIG. 5 is a block diagram showing a control unit for the image forming apparatus according to the embodiment of the present invention.

FIG. 5 is a block diagram showing a control circuit in the image forming apparatus having the above-mentioned structure.

Referring to FIG. 5, reference numeral 40 represents a CPU. The CPU 40 controls the image forming operation in accordance with a program stored in a ROM (not shown) or data stored in a RAM. Reference numeral 41 represents a main motor 41 for rotating the photosensitive drum 7 and the fixing unit 20. Reference numeral 42 represents a main-motor rotating circuit 42 for rotating the main motor 41 in accordance with an instruction issued from the CPU 40. Reference numeral 43 represents a main-motor encoder joined to a rotational shaft of the main motor and arranged to detect a state of rotation of the main motor. Reference numeral 44 represents a transfer-paper feed clutch 44 for turning the operation of the feed roll 17 on or off.

The image forming apparatus having the above-mentioned structure is able to prevent occurrence of an image defect called a "smudge" image disorder called a "smudge" and enlargement of the cost and size of the apparatus, maintain the productivity and reliability, eliminate a necessity of waiting for start of the image forming operation and effectively prevent image disorder called a "smear" occurring because of deformation of the pressurizing roller.

Figure 6:
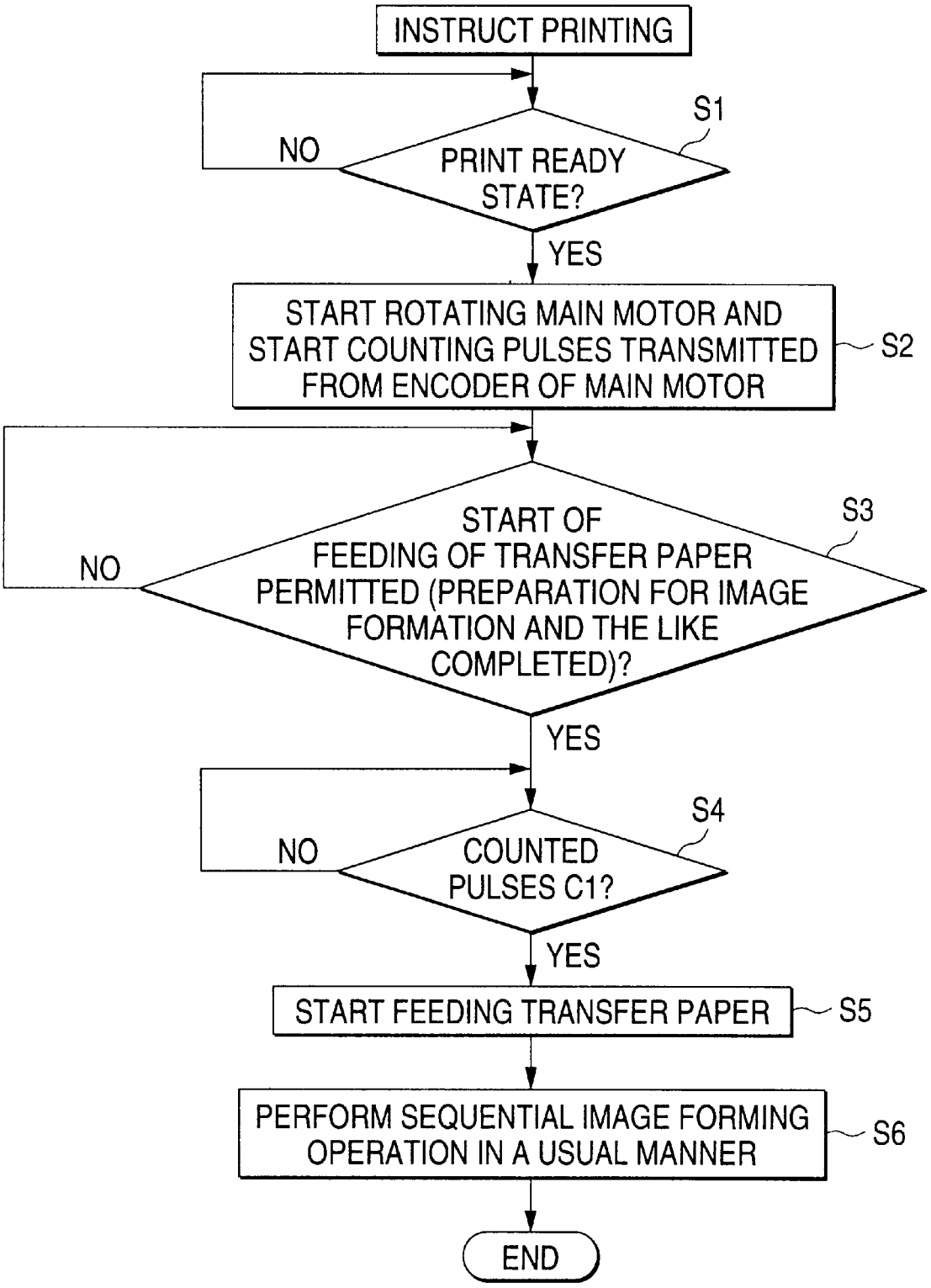
FIG. 6 is a flow chart of the operation of the image forming apparatus according to the embodiment of the present invention.

That is, the image forming apparatus having the above-mentioned structure is, as shown in FIG. 6, arranged such that when a user has set image forming conditions, including the size of the transfer paper and magnification and depresses a copy button to instruct printing, the CPU 40 determines whether not the state of the image forming apparatus is in a print ready state (step 1). Then, the print ready state is waited for. When the CPU 40 has determined that the print ready state has been realized (step 1), the CPU 40 starts rotating the main motor 41 through the main-motor rotating circuit 42. Moreover, the CPU 40 starts counting pulses which are transmitted from the encoder 43 of the main motor 41 (step 2).

Figure 7:
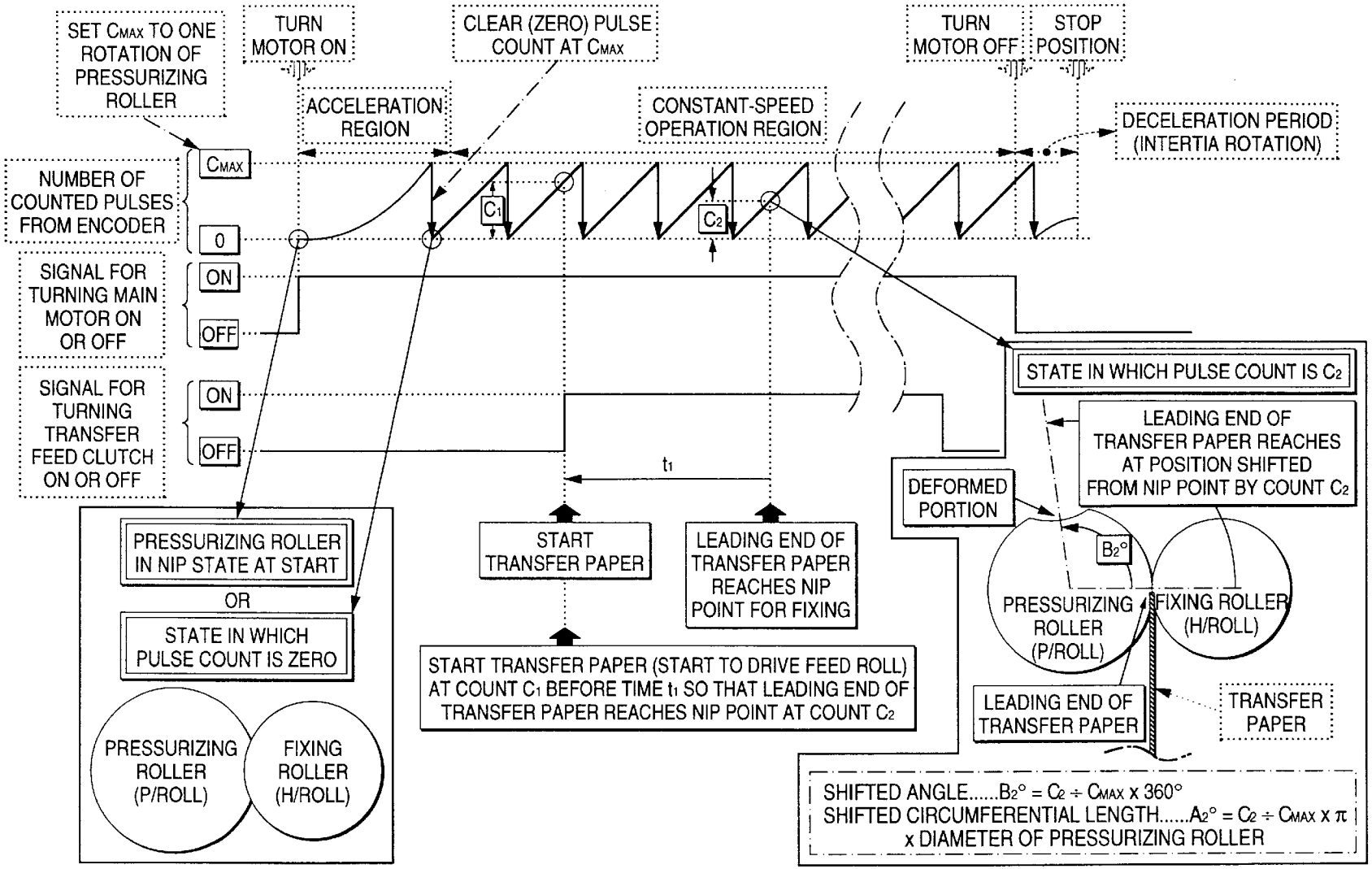
FIG. 7 is a timing chart of a control operation of the image forming apparatus according to the embodiment of the present invention.

Specifically, the image forming apparatus having the above-mentioned structure is arranged such that when the print ready state has been realized, the CPU 40, as shown in FIG. 7, turns on a signal for turning the main motor on or off. Thus, the CPU 40 starts rotating the main motor 41 through the main-motor rotating circuit 42. Thus, the encoder 43 joined to the rotational shaft of the main motor 41 sequentially transmits pulses when the main motor 41 is rotated. Then, the CPU 40 starts counting the pulses transmitted from the encoder 43 of the main motor 41.

The pulses transmitted from the encoder 43 are counted after the count has been reset to be zero simultaneously with the start of the rotation of the main motor 41. When the counted number of the pulses reaches a predetermined value $C_{MAX}$, the count is reset to be zero. The count $C_{MAX}$ of the pulses transmitted from the encoder 43 is determined to correspond to one rotation of the pressurizing roller 29 of the fixing unit 20.

The image forming apparatus has an arrangement that whether or not preparation for an image forming process and the like has been completed and thus start of feeding the transfer paper 12 is permitted is determined (step 3). A state in which start of feeding the transfer paper 12 is performed is waited for. When the count of the pulses reaches predetermined value $C_1$ after feeding of the transfer paper 12 has been permitted, the CPU 40 turns on a signal for turning a transfer-paper feed clutch 44 on or off so that feeding of the transfer paper 12 is started, as shown in FIG. 7.

The count $C_1$ of the pulses transmitted from the encoder 43 is determined to be a value with which the leading end of the transfer paper 12 is introduced into the contact portion apart from a deformed position 29*a* of the pressurizing roller 29 of the fixing unit 20 by a predetermined angle B2° in the downstream direction of rotation of the pressurizing roller 29 from the start of feeding of the transfer paper 12, as shown in FIG. 1A. Note that the predetermined angle B2° is set such that $B2° = C_1 \div C_{MAX} \times 360°$. That is, feeding of the transfer paper 12 is started when the count of the pulses is $C_1$. A moment at which count $C_1$ is realized is earlier than a moment at which count $C_2$ of the pulses is realized which is timing at which the deformed position 29*a* of the pressurizing roller 29 reaches a position apart from the contact portion with the fixing roller 28 by a predetermined angle B2° in the upstream direction of rotation of the pressurizing roller 29. The moment at which the count $C_1$ is realized is earlier than the moment at which count $C_2$ is realized by time t1 which is time required for the leading end of the transfer paper 12 from start of feeding of the transfer paper 12 to reach the contact portion between the fixing roller 28 and the pressurizing roller 29.

Therefore, if feeding of the transfer paper 12 is started when the count of the pulses transmitted from the encoder 43 is a predetermined value $C_1$, the leading end of the transfer paper 12 is, as shown in FIG. 1A, introduced into the contact portion which is apart from the deformed position 29*a* of the pressurizing roller 29 of the fixing unit 20 by the predetermined angle B2° in the downstream direction of rotation of the pressurizing roller 29.

As described above, the image forming apparatus according to this embodiment has the significantly simple structure that control is performed in such a manner that the portion in the vicinity of the deformed position 29*a* of the pressurizing roller 29 and the leading end 12*a* of the transfer paper 12 do not coincide with each other. Thus, the necessity of enlarging the amount of a loop of the transfer paper 12 at a position between the transferring position of the photosensitive drum 7 and the fixing unit 20 can be eliminated. Therefore, generation of an image defect called a "smudge" can be prevented. Moreover, the mechanism for suspending the contact between the fixing roller 28 and the pressurizing roller 29 is not required. Therefore, the cost and size of the apparatus can be reduced. Since timing at which the transfer paper 12 is fed is required to simply be set to be predetermined timing, complicated control is not required. Therefore, the productivity and reliability can be maintained. Moreover, the necessity of waiting for start of the image forming operation can be eliminated. Therefore, image disorder called a "smear" occurring because of deformation of the pressurizing roller 29 can effectively be prevented.

Figure 9:
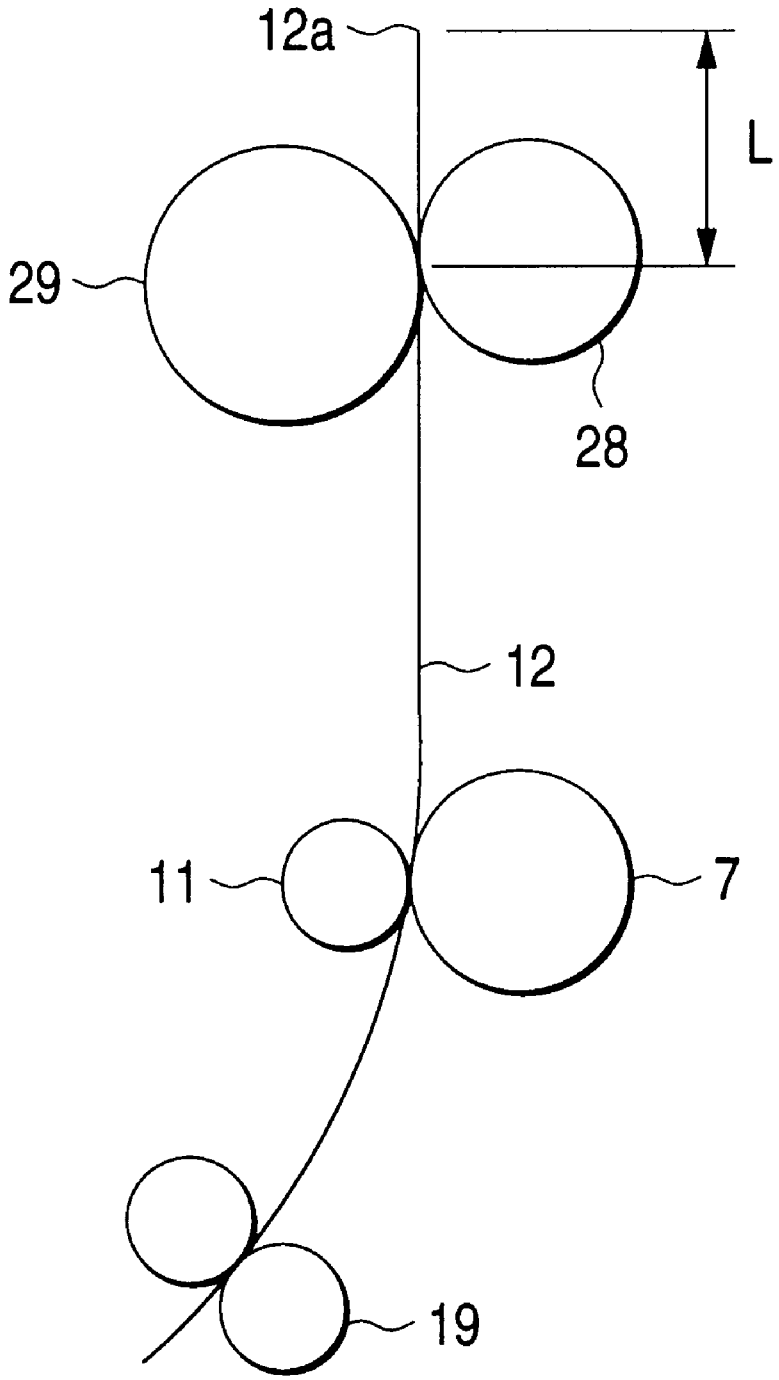
FIG. 9 is a diagram showing the relationship in terms of positions between a deformed portion of the pressurizing member of a pressurizing roller and the leading end of transfer paper.

To confirm the effects of the above-mentioned image forming apparatus according to the present invention, the inventors of the present invention carried out experiments. The image forming apparatus structured as shown in FIG. 3 was used and the relationship L in terms of the positions between the deformed position 29*a* of the fixing unit 20 and the leading end 12*a* of the transfer paper 12 was changed, as shown in FIG. 9. Thus, change in the degree of occurrence of image disorder called a "smear" was evaluated.

Figure 8:
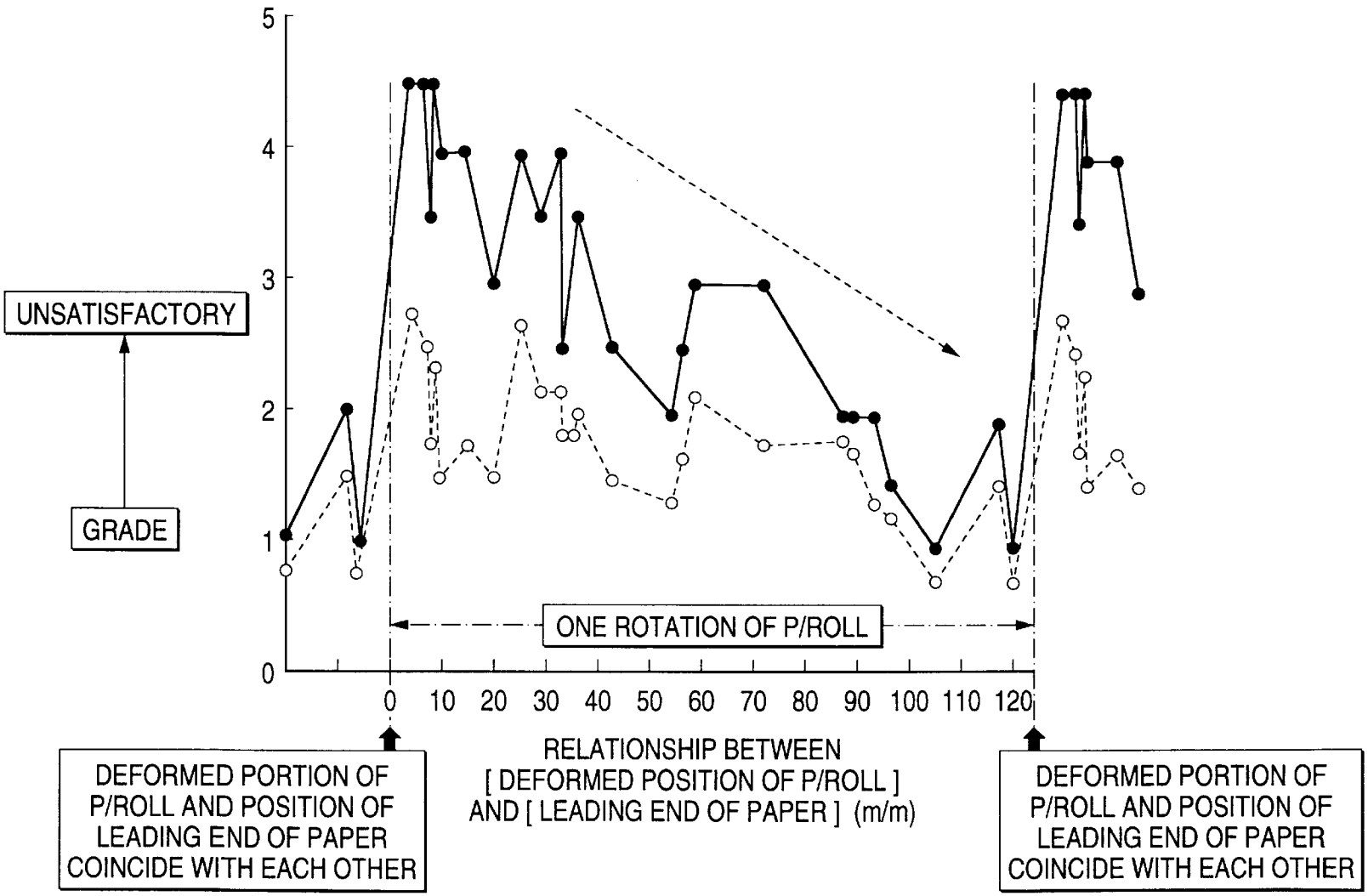
FIG. 8 is a graph showing results of experiments.

FIG. 8 shows results of the above-mentioned experiments. Note that a slid line shown in FIG. 8 indicates maximum values of the degree of image disorder called a "smear" and a dashed line indicates average values of the degree of image disorder called a "smear". Referring to FIG. 8, zero point on the axis of abscissa stands for a state in which the deformed position of the pressurizing roller 29 of the fixing unit 20 and the leading end of the transfer paper 12 coincide with each other.

As can be understood from FIG. 8, the position directly behind the position at which the deformed position 29*a* of the pressurizing roller 29 of the fixing unit 20 and the leading end of the transfer paper 12 coincide with each other is the position at which the degree of occurrence of image disorder called a "smear" is brought to the worst condition. In proportion to the distance from the deformed position 29*a* of the pressurizing roller 29 of the fixing unit 20 to the leading end of the transfer paper 12, the degree of occurrence of the image disorder called a "smear" is improved. The position immediately before the position at which the deformed position of the pressurizing roller 29 of the fixing unit 20 and the leading end 12*a* of the transfer paper 12 coincide with each other is the position at which the most satisfactory result can be obtained.

(Second Embodiment)

Figure 10:
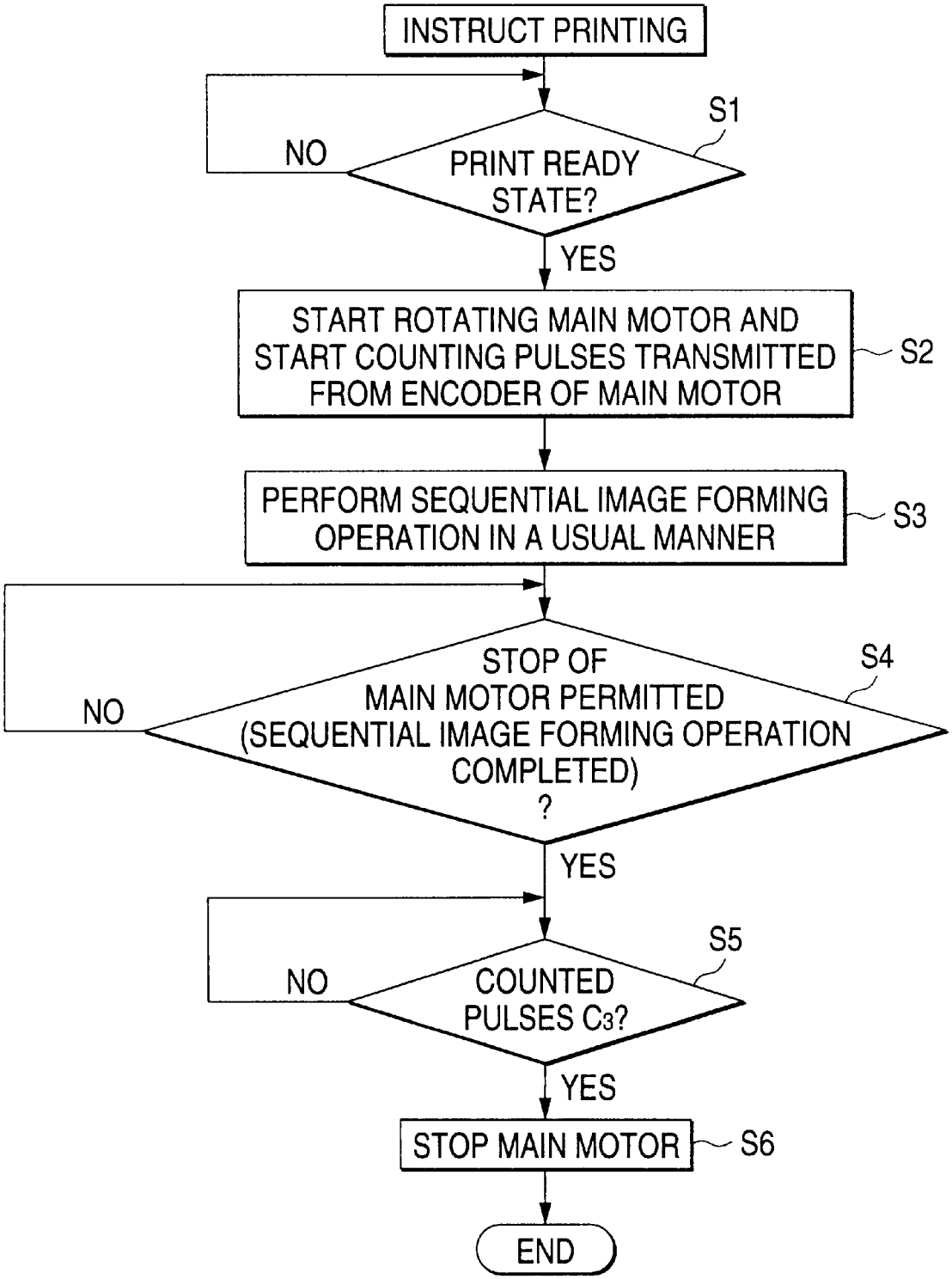
FIG. 10 is a flow chart of the operation of an image forming apparatus according to a second embodiment of the present invention.
Figure 11:
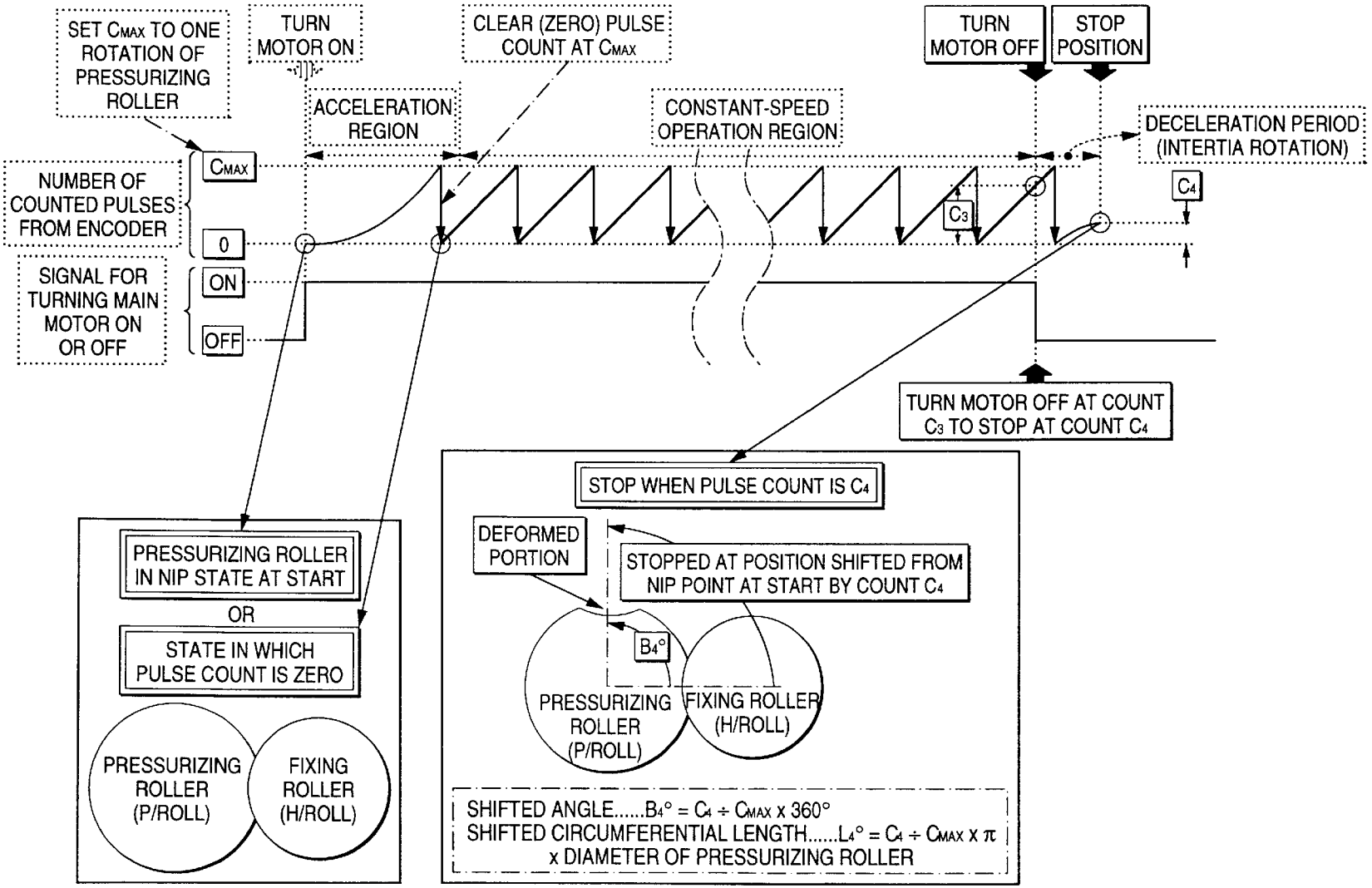
FIG. 11 is a timing chart of a control operation of the image forming apparatus according to the second embodiment of the present invention.

FIGS. 10 and 11 show a second embodiment of the present invention. The same elements as those of the foregoing embodiment are given the same reference numerals. The second embodiment has a structure that the deformed position of the pressurizing roller is made to be apart from a portion in the vicinity of the foregoing contact and stop position and then stop is performed.

That is, the image forming apparatus according to the second embodiment has the structure that the fixing roller 28 of the fixing unit 20 and the pressurizing roller 29 are, as described above, in contact with each other under a predetermined pressure. Therefore, when the image forming operation has been completed, the rotations of the fixing roller 28 and the pressurizing roller 29 are interrupted in a state in which the metal fixing roller 28 is in contact with the elastic layer 33 of the pressurizing roller 29, as shown in FIG. 1B. Since the pressurizing roller 29 is pressed by the fixing roller 28, the elastic layer 33 of the pressurizing roller 29 is deformed, as shown in FIG. 1B.

The pressurizing roller 29 is stopped in the deformed state as shown in FIG. 1B, and then the sequential image forming operation is completed and the rotation is again stopped. At this time, the inventors of the present invention have found a fact as a result of experiments that the relationship in terms of the positions between the position 29*a* which is the previous stop position and the deformed position realized because of stop at this time affects the state of occurrence of image disorder called a "smear".

Figure 12:
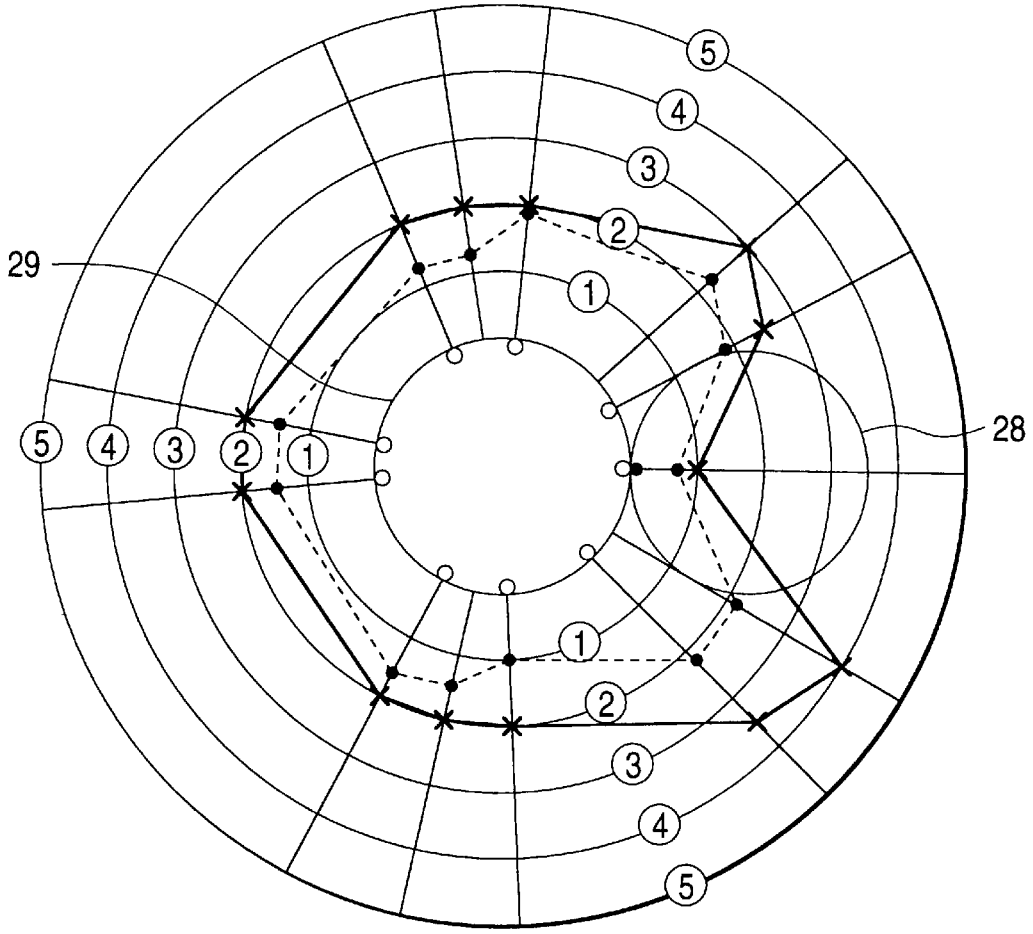
FIG. 12 is a graph showing results of experiments.
Figure 13:
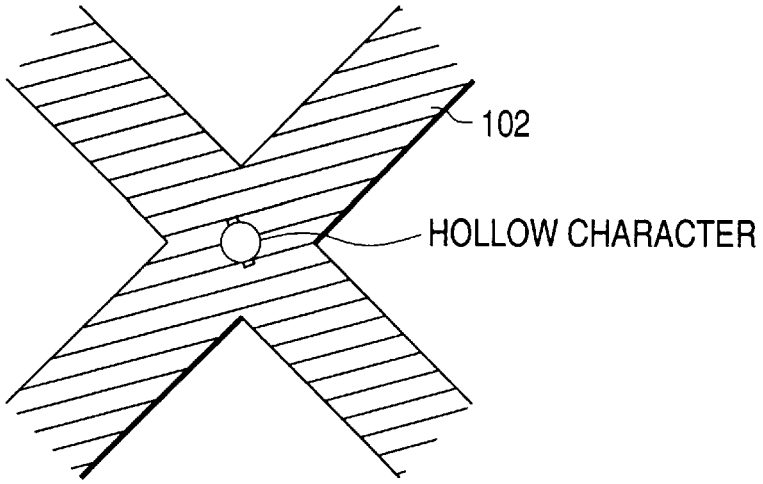
FIG. 13 is a diagram showing image defects experienced with a conventional image forming apparatus.
Figure 14:
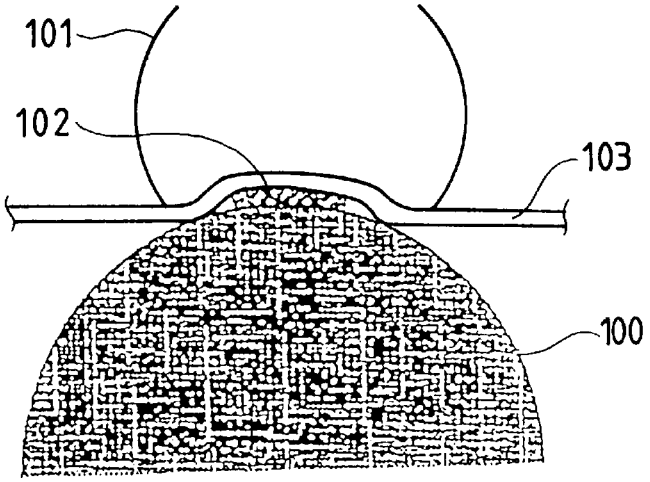
FIG. 14 is a diagram showing image defects experienced with the conventional image forming apparatus.
Figure 15:
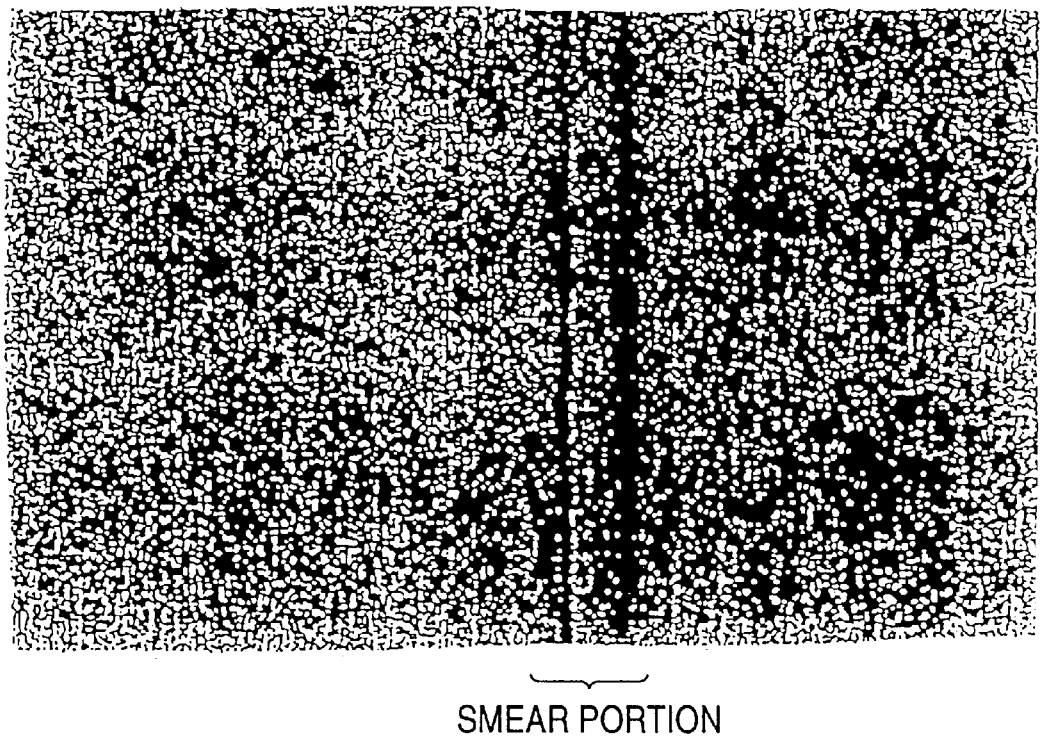
FIG. 15 is a test chart showing image defects experienced with the conventional image forming apparatus.
Figure 16:
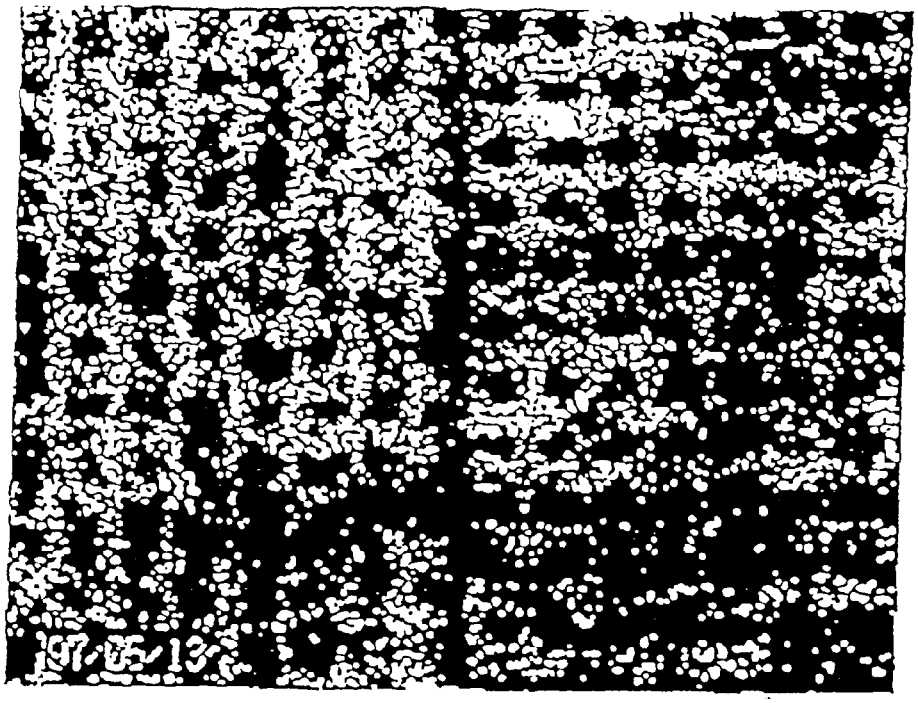
FIG. 16 is an enlarged view showing image defects experienced with the conventional image forming apparatus.

FIG. 12 shows results of experiments to confirm change in the state of occurrence of image disorder called a "smear" in accordance with the relationship between the position at which the previous deformation takes place and the deformed position realized due to a next stop.

As can be understood from the results of the experiments, if the rotations are stopped at the same position as the previous deformed position of the pressurizing roller 29, relatively satisfactory state of occurrence of image disorder called a "smear" is realized. However, the portions upstream and downstream of the position in the vicinity of the position at which previous deformation of the pressurizing roller 29 has took place result in unsatisfactory state of occurrence of image disorder called a "smear". The reason for this lies in that deformation of the elastic layer 33 on the surface of the pressurizing roller 29 is enlarged because of the pressure of the fixing roller 28 which is stopped at a position somewhat apart from the deformed position 29*a* if the rotation is stopped at a position in the vicinity of the position at which the pressurizing roller 29 has been deformed.

Specifically, a small black dot shown in FIG. 12 and given to the fixing roller 28 indicates the stop position before the image forming operation is started. A small white dot given to the pressurizing roller 29 indicates the stop position before the previous image forming operation is started. Therefore, the present contact position between the fixing roller 28 and the pressurizing roller 29 at which the black dot of the fixing roller 28 and the white dot of the pressurizing roller 29 coincide with each other indicates a state in which the portion of the pressurizing roller 29 which has been deformed in the previous image forming operation is again brought to the contact position with the fixing roller 28. The other white dots of the pressurizing roller 29 indicate a state in which the portion deformed in the previous image forming operation is stopped at a position apart from the contact point with the fixing roller 28. Note that data indicated with small black dots shown in FIG. 12 indicate an average value of six portions of three transfer members. While symbol x indicates worst grade of the smear grade measured at six portions of three transfer members.

The second embodiment has the structure that rotation is stopped such that the deformed position 29*a* of the pressurizing roller 29 is made to be apart from the portion in the vicinity of the contact portion with the fixing roller 28.

As described above, the image forming apparatus having the above-mentioned structure and according to the second embodiment is able to prevent occurrence of an image defect image called a "smudge", reduce the cost and the size of the apparatus, maintain the productivity and reliability, and eliminate the necessity of waiting for the start of the image forming operation. Moreover, image disorder called a "smear" occurring because of deformation of the pressurizing roller 29 can effectively be prevented.

That is, the image forming apparatus having the above-mentioned structure is, as shown in FIG. 10, arranged such that when a user has set image forming conditions, including the size of the transfer paper and magnification and depresses a copy button to instruct printing, the CPU 40 determines whether not the state of the image forming apparatus is in a print ready state (step 1). Then, the print ready state is waited for. When the CPU 40 has determined that the print ready state has been realized (step 1), the CPU 40 starts rotating the main motor 41 through the main-motor rotating circuit 42. Moreover, the CPU 40 starts counting pulses which are transmitted from the encoder 43 of the main motor 41 (step 2).

Specifically, the image forming apparatus having the above-mentioned structure is arranged such that when the print ready state has been realized, the CPU 40, as shown in FIG. 11, turns on a signal for turning the main motor on or off. Thus, the CPU 40 starts rotating the main motor 41 through the main-motor rotating circuit 42. Thus, the encoder 43 joined to the rotational shaft of the main motor 41 sequentially transmits pulses when the main motor 41 is rotated. Then, the CPU 40 starts counting the pulses transmitted from the encoder 43 of the main motor 41.

The pulses transmitted from the encoder 43 are counted after the count has been reset to be zero simultaneously with the start of the rotation of the main motor 41. When the counted number of the pulses reaches a predetermined value $C_{MAX}$, the count is reset to be zero. The count $C_{MAX}$ of the pulses transmitted from the encoder 43 is determined to correspond to one rotation of the pressurizing roller 29 of the fixing unit 20.

The image forming apparatus sequentially performs a usual image forming process, as shown in FIG. 10 (step 3). Then, the transfer paper 12 to which the toner image has been formed is discharged to the upper surface of the paper-discharge tray 22.

Then, the CPU 40 determines whether or not the sequential image forming operation has been completed and the rotation of the main motor 41 can be stopped (step 4). Then, a state in which the rotation of the main motor 41 can be stopped is waited for. If the state in which the rotation of the main motor 41 can be stopped is realized, the CPU 40, as shown in FIG. 11, turns off the signal for turning the main motor 41 on or off at a moment at which the count of the pulses has been made to be a predetermined value $C_3$ after the state in which the rotation of the main motor 41 can be stopped has been realized. Thus, the CPU 40 stops the rotation of the main motor 41.

The count $C_3$ of the pulses transmitted from the encoder 43 is determined to be a value with which the contact point between the fixing unit 20 and the fixing roller 28 is brought to a position apart from the deformed position 29*a* of the pressurizing roller 29 of the fixing unit 20 in the downstream direction of rotation of the pressurizing roller 29 by a predetermined angle of B4° after the main motor 41 has been stopped. That is, the main motor 41 is stopped at a moment at which the count $C_3$ of the pulses is realized. The moment at which the count $C_3$ is realized is earlier than count $C_4$ of pulses which is timing at which the deformed position 29*a* of the pressurizing roller 29 of the fixing unit 20 reaches a position apart from the contact portion with the fixing roller 28 by a predetermined angle B2 in the upstream direction of rotation of the pressurizing roller 29. The moment at which the count $C_3$ is realized is earlier than the moment at which the count $C_4$ is realized by time t2 which is time required for the fixing roller 28 of the fixing unit 20 and the pressurizing roller 29 to be actually stopped from the moment at which the main motor 41 has been stopped.

Therefore, when the main motor 41 is stopped at the moment at which the count of the pulses transmitted from the encoder 43 is the predetermined value $C_3$, the contact portion of the pressurizing roller 29, as shown in FIG. 11, is stopped at the position apart from the deformed position 29*a* of the pressurizing roller 29 of the fixing unit 20 by a predetermined angle B4° in the downstream direction of rotation of the pressurizing roller 29.

As described above, the image forming apparatus according to this embodiment has the significantly simple structure that the deformed position 29*a* of the pressurizing roller 29 is stopped at a position apart from the portion in the vicinity of the contact and stop position. Therefore, image disorder called a "smear" occurring because of deformation of the pressurizing roller 29 can effectively be prevented.

The other structures and operations are similar to those according to the foregoing embodiment. Therefore, the similar portions are omitted from description.

The control operations described in the first and second embodiments are performed to prevent image disorder called a "smear" occurring because of deformation of the elastic layer 33 formed on the surface of the pressurizing roller 29 because the fixing roller 28 and the pressurizing roller 29 are stopped in a contact state. Therefore, the deformed position 29*a* of the pressurizing roller 29 is basically the contact portion with the fixing roller 28 immediately before the image forming operation is started.

The structure of the present invention is not limited to the above-mentioned structure. The deformed position 29*a* of the pressurizing roller 29 may be the contact portion with the fixing roller 28 immediately before the image forming operation is started or the contact portion with the fixing roller 28 immediately before the previous image forming operation is performed. In the foregoing cases, also the deformed position 29*a* of the pressurizing roller 29 because of the contact with the fixing roller 28 immediately before the previous image forming operation is performed can be avoided. Thus, generation of image disorder called a "smear" occurring because of deformation of the pressurizing roller 29 can furthermore effectively be prevented.

The above-mentioned control is basically performed whenever an image forming operation is performed. If time taken from completion of a previous image forming operation to start of a next image forming operation is too short, the influence of the deformation of the pressurizing roller 29 cannot easily be continued. Therefore, a usual image forming operation may be performed without performing the above-mentioned control.

Therefore, when the deformed portion of the pressurizing member is a contact portion with the fixing member when the image forming apparatus has been allowed to stand for a long time in a state in which an image forming operation is interrupted, the present invention is significantly effective. Time for which the image forming operation may be measured to perform the above-mentioned control only when the interruption time exceeds a predetermined time.

The structure may be formed such that a state in which a power source for the image forming apparatus is turned on and a state in which the mode is returned from a special mode in which a service person adjust the apparatus or repair breakdown or a power saving mode are determined as a state where the image forming apparatus is allowed to stand for a long time is determined.

Control may be performed such that the leading end of the transfer member is introduced into a contact portion between the fixing member and the pressurizing member immediately after the deformed portion of the pressurizing member has passed through the contact portion with the fixing member.

The structure may be arranged such that only a first sheet in a sequential image forming job is controlled such that the portion in the vicinity of the deformed portion of the pressurizing member and the leading end of the transfer member do not coincide with each other. If the image forming operations are continuously performed for second and third sheets, the deformation of the pressurizing roller 29 is restored. Therefore, only the first sheet in the sequential image forming job on which the influence of the deformation of the pressurizing roller 29 excessively exerted is controlled in such a manner that the portion in the vicinity of the deformed portion of the pressurizing member of the pressurizing member and the leading end of the transfer paper do not coincide with each other. As a matter of course, the control is not limited to only the first sheet in the sequential image forming job. The above-mentioned control is required to only the sheet, the second sheet or the third sheet on which the influence of the deformation of the pressurizing roller 29 is exerted to cause an image defect to occur.

As described above, according to the present invention, an image forming apparatus can be provided which is able to prevent occurrence of image defect called a "smudge", reduce the cost and size of the apparatus, maintain the productivity and reliability, eliminate a necessity of waiting for start of the image forming operation and effectively prevent occurrence of image disorder called a "smear" occurring because of deformation of the pressurizing roller.

What is claimed is:

1. An image forming apparatus comprising:

a transfer member having a leading end;

a fixing member having a heat source;

a pressurizing member having an elastic layer; and a fixing unit to perform a fixing process by bringing the fixing member and the pressurizing member into contact with each other such that the pressurizing member has a deformed portion, wherein a portion in a vicinity of the deformed portion of said pressurizing member and the leading end of the transfer member are both controlled not to coincide with each other.

2. The image forming apparatus of claim 1, wherein the deformed portion of said pressurizing member is a contact portion with said fixing member immediately before an image forming operation is started.

3. The image forming apparatus of claim 1, wherein the deformed portion of said pressurizing member is a contact portion with said fixing member immediately before an image forming operation is started and a contact portion with said fixing member immediately before a previous image forming operation is started.

4. The image forming apparatus of claim 1, wherein the deformed portion of said pressurizing member is a contact portion with said fixing member when said image forming apparatus has been allowed to stand for a long time in a state in which an image forming operation is interrupted.

5. The image forming apparatus of claim 4, wherein a state in which a power source for said image forming apparatus is turned on and a state in which the mode is returned from a special mode or a power saving mode are determined as a state where said image forming apparatus is allowed to stand for a long time is determined.

6. The image forming apparatus of claim 1, wherein the leading end of the transfer member is controlled to be introduced into a contact portion between said fixing member and said pressurizing member immediately after the deformed portion of said pressurizing member has passed through the contact portion with said fixing member.

7. The image forming apparatus of claim 1, wherein only a first sheet in a sequential image forming job is controlled such that the portion in the vicinity of the deformed portion of said pressurizing member and the leading end of the transfer member do not coincide with each other.

8. An image forming apparatus comprising a transfer member having a leading end;

a fixing member having a heat source;

a pressurizing member having an elastic layer; and a fixing unit to perform a fixing process by bringing the fixing member and the pressurizing member into contact with each other such that the pressurizing member has a deformed portion, wherein the deformed portion of said pressurizing member is controlled to be apart relative to a portion in a vicinity of a contact and stop position of the pressurizing and fixing members.

9. The image forming apparatus of claim 8, wherein the deformed portion of said pressurizing member is a contact portion with said fixing member immediately before an image forming operation is started.

10. The image forming apparatus of claim 8, wherein the deformed portion of said pressurizing member is a contact portion with said fixing member immediately before an image forming operation is started and a contact portion with said fixing member immediately before a previous image forming operation is started.

11. The image forming apparatus of claim 8, wherein the deformed portion of said pressurizing member is a contact portion with said fixing member when said image forming apparatus has been allowed to stand for a long time in a state in which an image forming operation is interrupted.

12. The image forming apparatus of claim 8, wherein a state in which a power source for said image forming apparatus is turned on and a state in which the mode is returned from a special mode or a power saving mode are determined as a state where said image forming apparatus is allowed to stand for a long time is determined.

13. The image forming apparatus of claim 8, wherein said pressurizing member is controlled to be stopped immediately after a portion in the vicinity of the deformed portion of said pressurizing member has passed through a contact portion with said fixing member.

14. The image forming apparatus of claim 1, wherein control means for controlling the operation performs control in accordance with a count of encoder pulses of a main motor.

15. The image forming apparatus of claim 8, wherein control means for controlling the operation performs control in accordance with a count of encoder pulses of a main motor.

* * * * *